US005359841A

United States Patent [19]

Stahlecker et al.

[11] Patent Number: 5,359,841

[45] Date of Patent: Nov. 1, 1994

[54] SPINNING MACHINE

[76] Inventors: Fritz Stahlecker, Josef-Neidhart-Strasse 18, 7347 Bad Überkingen, Germany; Hans Stahlecker, Haldenstrasse 20, 7334 Süssen, France

[21] Appl. No.: 894,520

[22] Filed: Jun. 4, 1992

Related U.S. Application Data

[63] Continuation-in-part of Ser. No. 948,638, Sep. 23, 1992.

[30] Foreign Application Priority Data

Dec. 21, 1990 [DE] Germany ..... 4041112
Jan. 11, 1991 [DE] Germany ..... 4100618
Jun. 5, 1991 [DE] Germany ..... 4118379

[51] Int. Cl.[5] ..... D01H 13/04
[52] U.S. Cl. ..... 57/90; 57/281
[58] Field of Search ..... 57/90, 315, 281

[56] References Cited

U.S. PATENT DOCUMENTS 2,710,428 6/1955 Nutter et al. ..... 57/315 X
2,736,162 2/1956 Steinberger ..... 57/90 X
3,043,083 7/1962 Noguera ..... 57/315
3,312,050 4/1967 Noguera ..... 57/90
3,564,829 2/1971 Tsuzuki ..... 57/90 X
3,727,391 4/1973 Hiserman et al. ..... 57/315
3,844,098 10/1974 Plate et al. ..... 57/315
3,884,026 5/1975 Yoshizawa et al. ..... 57/281
4,078,369 3/1978 Brandis ..... 57/281 X
4,357,793 11/1982 Gasser et al. ..... 57/315 X

FOREIGN PATENT DOCUMENTS 1015780 1/1966 United Kingdom .

*Primary Examiner*—Joseph J. Hail, III
*Attorney, Agent, or Firm*—Evenson, McKeown, Edwards & Lenahan

[57] ABSTRACT

In the case of a spinning machine with spinning stations preferably arranged on both sides of the machine, depositing sites for several rows of cans containing the sliver to be spun are assigned to each side of the machine while leaving an aisle. In a roof-type manner, transport devices extend over the operating aisle by means of which the slivers are taken out of the cans and are fed to the spinning stations. The transport devices have two transport sections respectively which are connected with one another by way of a deflecting guide.

26 Claims, 5 Drawing Sheets

1
2
3
4
5
6
7
8
9
10
11
12
13
14
23
25
28
29
51
52
53
54
55
56
57
58
59

SPINNING MACHINE

This application is a continuation-in-part application of copending application Ser. No. 07/948,638, filed Sep. 23, 1992.

BACKGROUND AND SUMMARY OF THE INVENTION

The present invention relates to a spinning machine having a plurality of spinning stations arranged in a row next to one another on at least one side of the machine. Depositing sites for cans containing sliver to be spun are assigned to the spinning stations while leaving an operating aisle. Transport devices for transporting the slivers from the cans to the spinning stations.

It is known (British Patent Document 1 015 780) to feed the fiber material to be spun to a ring spinning machine in the form of slivers. The slivers are removed from large cans which, while leaving an operating aisle providing access to the spinning stations of the ring spinning machine, are deposited in four rows extending in the longitudinal direction of the machine on a platform which is approximately as high as the floor. The slivers are withdrawn from the cans by way of rollers arranged above the cans and are then guided by transport devices in the center between the four rows downward below the floor to the spinning machine, from there diagonally upward approximately to the machine center and from there to the drafting units. The transport devices are each composed of conveyor belt pairs which receive and transport a sliver between one another. Such ring spinning machine have not gained acceptance in practice.

It is an object of the invention to improve a spinning machine of the initially mentioned type with respect to the transport devices.

This object is achieved in that the transport devices of the present invention have two transport sections of which a first transport section starts above the cans, and a second transport section ends above the spinning stations, and in that the two transport sections bridge the operating aisle in the manner of a roof.

Transport devices of this type bridge the distance from the cans to the spinning stations along almost the shortest route which already results in a simplification of the transport devices. In addition, these transport devices are easily accessible so that servicing operations for the transport devices themselves as well as a starting of the operation during a start spinning and the elimination of disturbances during the spinning can easily be carried out on them. Also, transport devices of this type require only a relatively small number of driven and/or moving elements so that a secure functioning and a reliable operation are ensured.

In addition, the transport devices are designed such that they can also securely transport fine slivers, that is, slivers of sizes of from Nm 0.3 to Nm 0.8, without the risk of drafting during the transport. As a result, it is possible to do without the machine, specifically the flyer, which is normally still connected in front in the case of ring spinning machines. In addition, by means of such fine slivers, higher yarn qualities than previously can be achieved. Furthermore, these fine slivers permit the use of three-cylinder drafting units which are generally customary today without the requirement of carrying out important constructive changes on them.

Other objects, advantages and novel features of the present invention will become apparent from the following detailed description of the invention when considered in conjunction with the accompanying drawings.

BRIEF DESCRIPTION OF THE DRAWINGS

FIG. **4*b* is an enlarged cross-sectional view of a slide of the embodiment according to FIG. 4.

DETAILED DESCRIPTION OF THE DRAWINGS

Figure 1:
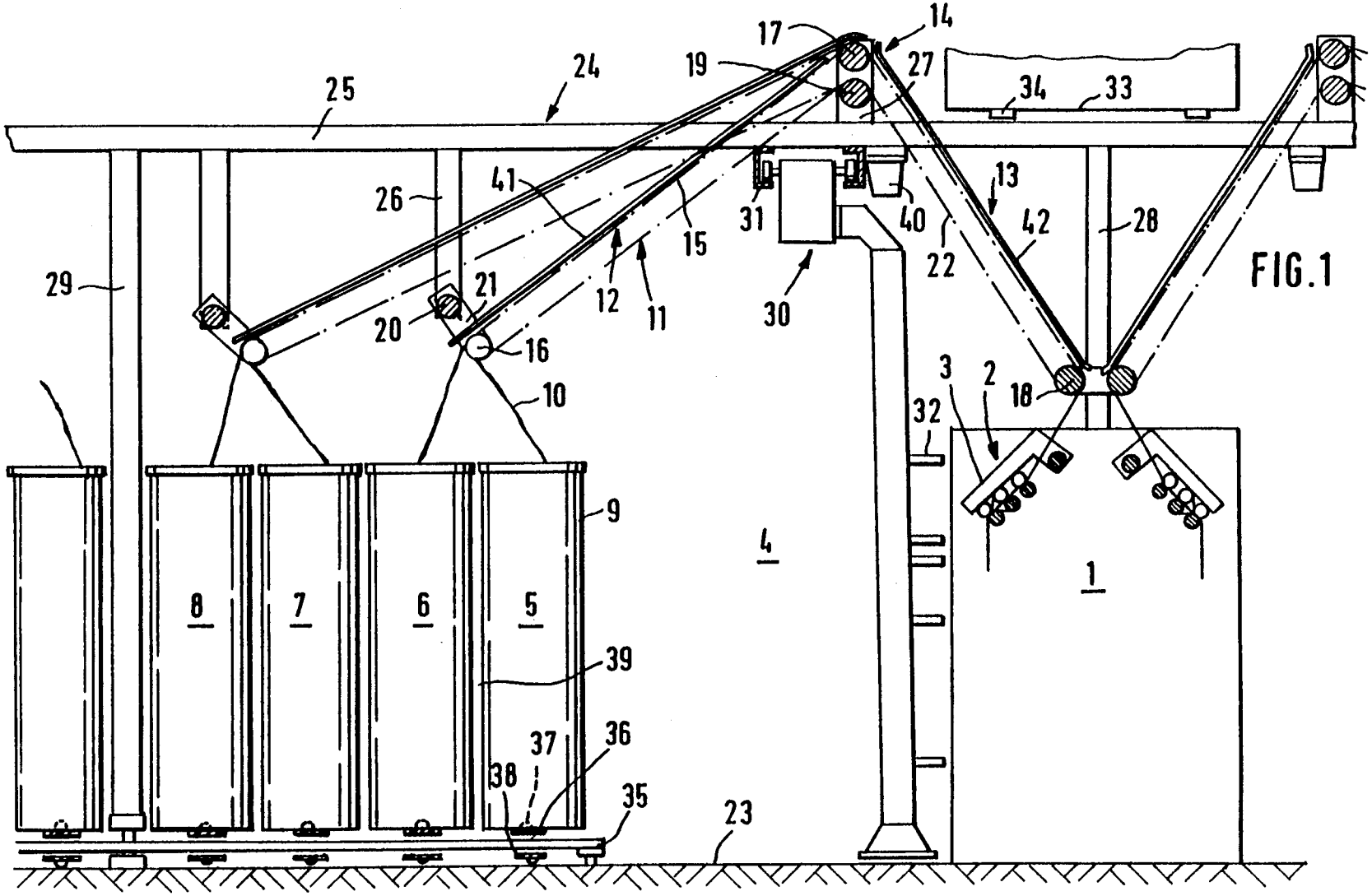
FIG. 1 is a partial cross-sectional view of a machine system with a spinning machine, to the spinning stations of which one sliver respectively is fed by means of a can, the slivers being conveyed from the cans to the spinning stations by means of conveyor belts, constructed according to a preferred embodiment of the present invention.

The spinning machine 1 illustrated in FIG. 1 which may, for example, be a spinning machine, is outlined only schematically. On both sides of the machine, it has a plurality of spinning stations 2 arranged next to one another, of which only one drafting unit 3 respectively is shown which is constructed as a three-cylinder drafting unit. An operating aisle 4 for the operating personnel is situated in front of the spinning stations 2 so that the spinning stations 2 are easily accessible for the operating personnel. On the opposite side of the operating aisle 4, four rows 5, 6, 7, 8 of cans 9 are deposited which contain the sliver material which is spun by the spinning stations 2 of one side of the machine.

The fiber material is fed to the spinning stations 2 as a sliver 10 produced on a drafting frame. The slivers 10 have a size of from approximately Nm 0.3 to Nm 0.8 so that they can be drafted to the desired yarn size by the three-cylinder drafting units 3 while the feeding roller pair of the three-cylinder drafting units 3 rotates at a sufficient rotational speed in order to ensure concentricity. The relatively fine slivers 10 are conveyed from the cans 9 to the spinning stations 2 by means of transport devices 11 in such a manner that an unintentional drafting is prevented during the transport. The transport devices 11 are constructed in such a manner that they bridge the operating aisle 4 in the manner of a roof. As a result, an operating aisle 4 is maintained which has a sufficient height while the transport devices 11 are nevertheless accessible for the operating personnel.

In the embodiment according to FIG. 1, the transport devices 11 comprise conveyor belts 15 which are illustrated by a dash-dotted line and which have a first section 12 extending upward over the operating aisle 4 and a second transport section 13 leading away from there, behind a deflecting guide 14, downward to the spinning stations 2. The conveyor belts 15 each travel around four deflecting rollers 16, 17, 18, 19. The deflecting rollers 17, 18, 19 are constructed as shafts which extend in the longitudinal direction of the machine along at least one machine section containing a plurality of spinning stations. The deflecting roller 18, which is situated directly above the drafting unit 3 of the spinning stations 2 and is constructed as a shaft extending through in the longitudinal direction of the machine, is driven at a machine end. Its rotational speed is selected to be such that the conveying speed of the conveyor belts 15 is approximately 1.5% lower than the feeding speed of the three-cylinder drafting units 3 so that the slivers 10 are held in a tensioned manner in the area in front of the drafting units 3, however, without the occurrence of any noticeable drafting in this case.

As illustrated in FIG. 1, the deflecting rollers 16 are arranged above the cans 9 in such a manner that they are disposed approximately in the center between the cans 9 of two rows 5, 6 and 7, 8. The conveyor belts 15 each have a width which is sufficient for receiving two slivers. These slivers 10 are withdrawn from the cans 9 which are adjacent in rows 5, 6; 7, 8 and are fed to two directly adjacent drafting units 3 to which a common load carrier is assigned for the pressure rollers constructed as pressure roller twins.

The deflecting rollers 16 arranged above the cans 9, at the same time, serve as tension rollers for the conveyor belts 15. They are individual rollers which are held by means of a swivelling lever 21 which can be swivelled around a rod 20 extending in the longitudinal direction of the machine and which, in a manner not shown in detail, is loaded by a tension spring, particularly a leaf spring. The returning ends 22 of the conveyor belts are guided by means of the deflecting roller 19 in such a manner that they extend essentially in parallel to the ends of the conveyor belts 15 conveying the slivers 10. As a result, it is achieved that a sufficient height for the operating aisle 4 is easily maintained.

The deflecting rollers 17, 18, 19 as well as the rods 20 with the swivelling levers 21 are held by a frame 24 which essentially comprises vertical columns 28, 29 and cross members 25. On these cross members 25 and possibly also on the vertical columns 28, holders 26, 27 are mounted by means of which the rods 20 as well as the deflecting rollers 17, 18, 19 are held or disposed.

As also illustrated in FIG. 1, the frame is also used for receiving additional equipment, such as a travelling blower 30 moving in the operating aisle 4 which is equipped with blowing and/or suction nozzles 32 aimed against the spinning machine 1 and the floor 23. The travelling blower 30 travels on rails 31 which are fastened to the frame in such a manner that the conveyor belts 15 are disposed above these rails.

In addition, the frame 24 carries an air-conditioning duct 33 which is equipped with blower nozzles 34 and guides the air-conditioned air into the area of the downward leading transport sections 13 to the slivers 10 so that these slivers 10 receive a suitable temperature and an appropriate humidity. Lighting devices 40 are also mounted on the frame 24 and are arranged above the operating aisle 4 and below the conveyor belts 15.

In order to protect the slivers 10 during their transport on the conveyor belts, particularly against influences of air currents, the ends of the conveyor belts 15 conveying the slivers 10 are covered by sliding skids 41, 42 which each extend along the transport sections 12 and 13. The sliding skids 41, 42 may rest on the slivers 10 by means of a smooth surface or may be arranged at a distance from them, in which case they will then expediently have a U-shaped cross-section and reach around the lateral edges of the conveyor belts. The sliding skids 41 42 connect with one another in the area of the deflecting guide 14 in which case the sliding skid 41 assigned to the first transport section 12 follows that of deflecting roller 17 with a slight bend so that, by means of the deflecting roller 17, the slivers 10 are deflected by it in the direction of the second transport section 13.

As also shown in FIG. 1, in the case of this embodiment, the cans 9 of rows 5, 6, 7, 8 stand on conveyor belts 36 extending in the longitudinal direction of the machine which are laid in a platform 35 arranged slightly above the floor 23. The conveyor belts 36 are equipped with button-type take-along devices 37 which reach behind the inner lower edge of the normally slightly elevated bottoms of the cans and take these along and convey them by means of a specific positive locking and hold them in the desired position. By means of the conveyor belts 36, which slide on the platform 35 and whose returning end 38 is returned below the platform, an automated delivery and removal of the cans 9 can be implemented in which case, when the conveyor belts 36 come to a stop, the cans 9 will automatically stop in the correct position in which they remain during the spinning operation.

Figure 2:
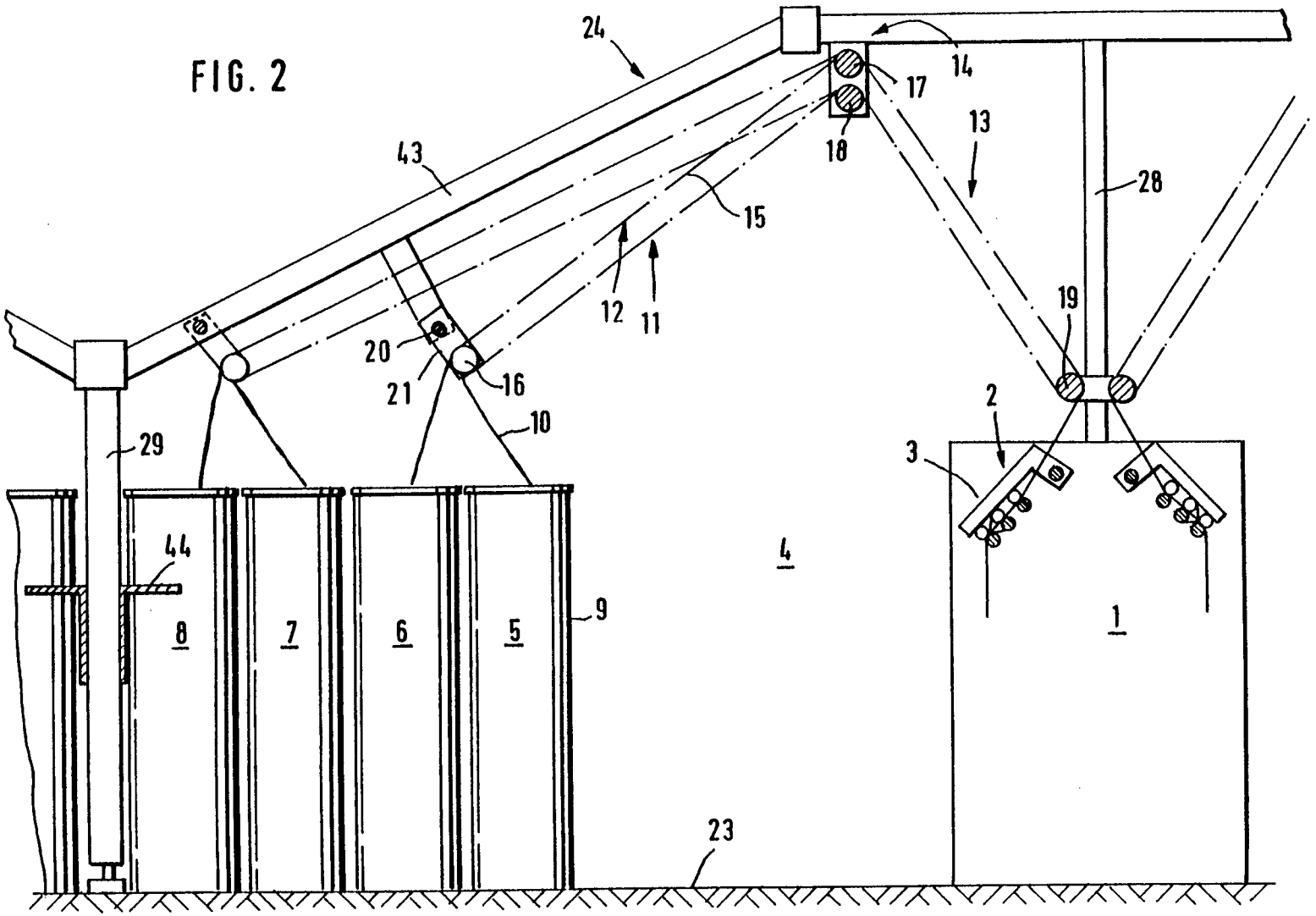
FIG. 2 is a partial view similar to FIG. 1 depicting a modified holding device for the transport devices and with modified depositing sites for the cans.

In its basic principle, the embodiment according to FIG. 2 corresponds to the embodiment according to FIG. 1. However, the frame 24, in a deviating manner, is designed such that the cross members 43 extend essentially in parallel to the first transport sections 12 of the conveyor belts 15. This reduces the height of the columns 29.

In addition, in the embodiment according to FIG. 2, the cans 9 stand directly on the floor 23. The vertical columns 44 are provided with guiding elements 44 which reach around the circumference of the cans 9 of the row 8 adjacent to them so that the cans 9 of the row 8 must be deposited in a defined position. Then the cans of the rows 5, 6 and 7 can be aligned correspondingly. The guiding elements 44 are constructed as rails extending in the longitudinal direction of the machine which are mounted on vertical supports 29 and which, for the row 8 of cans 9, are provided with a corresponding number of cutouts which receive the cans 9.

Figure 3:
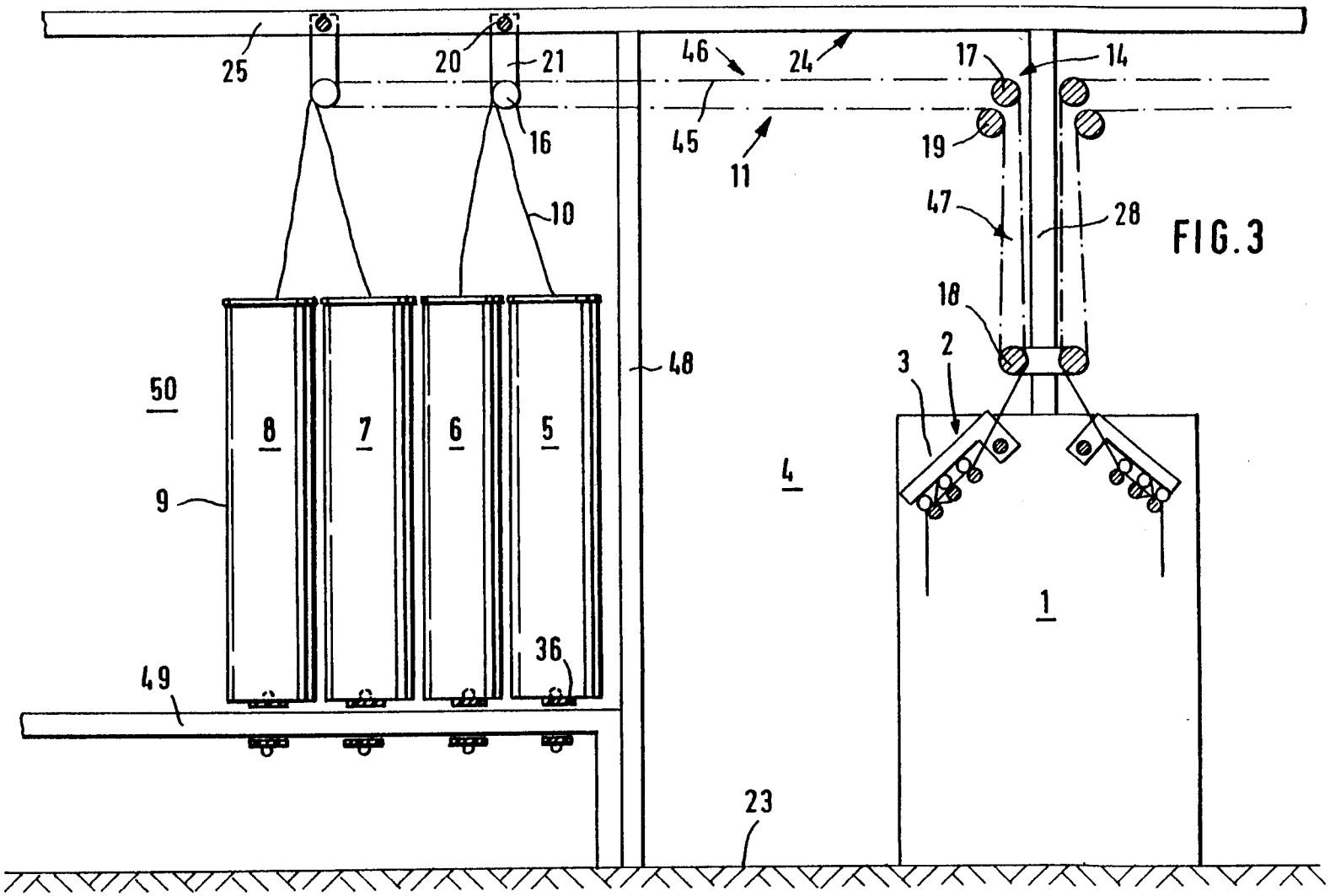
FIG. 3 is a partial view similar to FIG. 1 of another embodiment in which the depositing sites for the cans are arranged on a platform in an elevated manner.

In the embodiment according to FIG. 3, the transport devices 11 also comprise continuous conveyor belts 45 which form two transport sections 46, 47. The first transport section 46, which starts above the cans 9, extends essentially horizontally with respect to the spinning machine 1. The second transport section 47 is situated approximately in the machine center and extends essentially perpendicularly downward to the spinning stations 2. In order to avoid that the slivers 10 must be withdrawn from the cans 9 with excessively large free lengths, the cans 9 are deposited on an elevated platform 49 in an elevated manner such that the free length of the slivers 10 from the cans to the conveyor belts 45 does not exceed a permissible measurement, that is, a measurement at which, because of the own weight of the slivers 10, a drafting does not yet have to be feared. In the case of such an arrangement, it is expedient for another operating aisle 50 to be maintained also on the side of the row 8 of cans 9 facing away from the operating aisle 4. In order not to restrict this operating aisle, the vertical supports 48 of the frame 12 are displaced into the area of the operating aisle 4.

Figures 4, 4A, 4B:
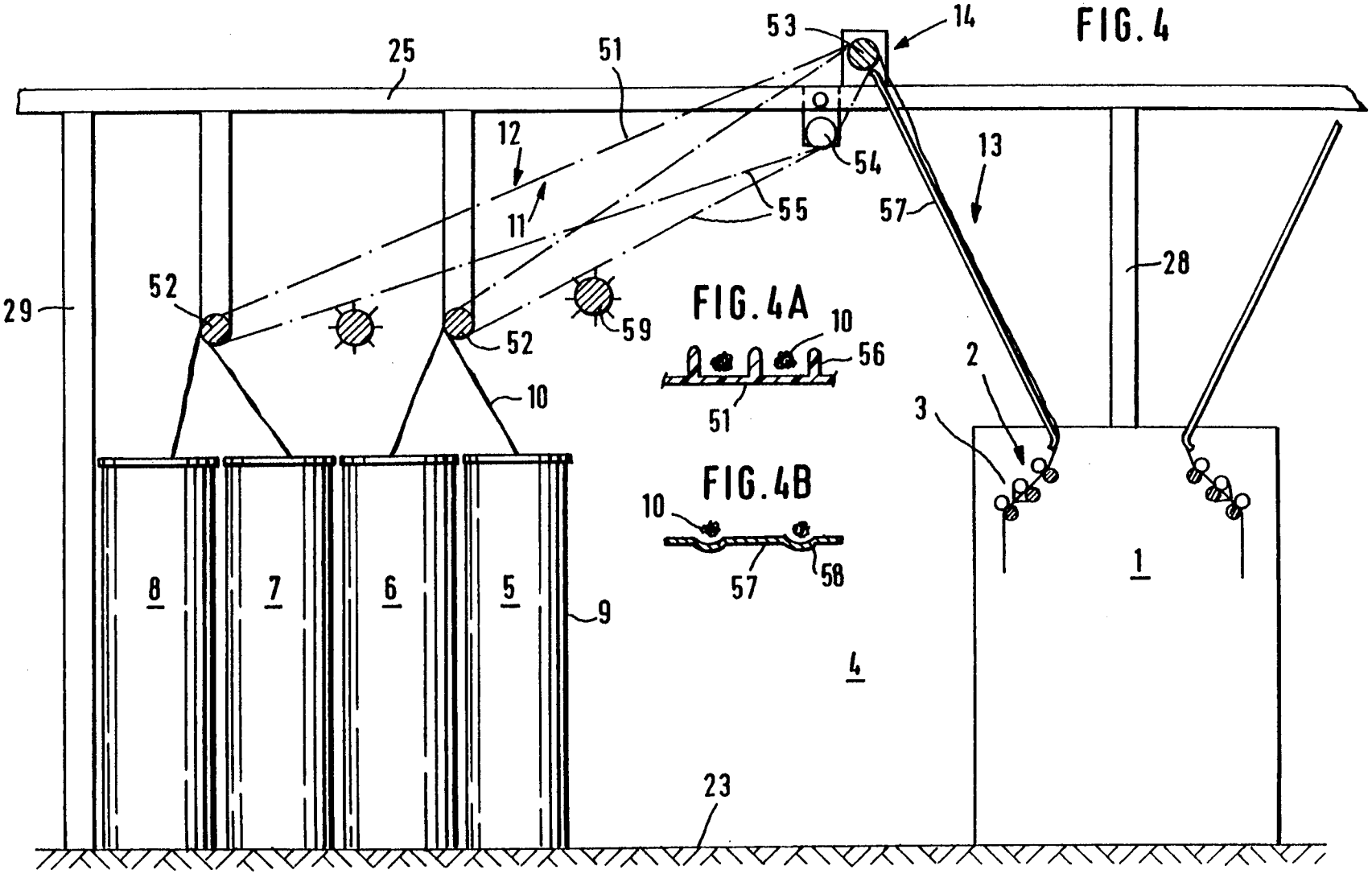
FIG. 4 is a partial view similar to FIG. 1 of another embodiment in which a first transport section is formed by conveyor belts and a second transport section is formed by slides.
FIG. 4A is an enlarged cross-sectional view of a conveyor belt corresponding to FIG. 4.

In the embodiment according to FIG. 4, the cans 9 of the rows 5, 6, 7, 8 stand on the floor 23. The first transport section 12 of the transport devices 11 in this embodiment is formed by conveyor belts 51 which extend only along this first transport section 12. The conveyor belts 51 are guided by way of two shafts 52, 53 extending through in the longitudinal direction of the machine, of which preferably the upper shaft which forms the deflecting point 14 is constructed as a driven shaft extending in the longitudinal direction of the machine. A tension roller 54 is assigned to the respective returning end 55. Also in this embodiment, the conveyor belts 51 are each used for the conveying of two slivers 10. Since the conveyor belts 51 are guided by the deflecting rollers 52, 53, 54 only by means of their interior side, they may be provided in a simple manner on their exterior side with a profiling, such as longitudinal webs 56, by which the two slivers 10 are kept separate from one another during the transport. These webs 56 protect the slivers 10 also from lateral air flows so that coverings or the like are not required.

In the embodiment according to FIG. 4, the second transport sections 13 of the transport devices 11 are formed by slides 57 which extend diagonally from the deflecting guide 14 downward to the drafting units 3 of the spinning stations 2. Taking into account their coefficient of friction with respect to the slivers 10, the slope of the slides 57 is selected such that, in the perpendicular direction, the slivers 10 are sufficiently protected with respect to their own weight so that, also when the spinning machine is stopped and the supply is interrupted, the slivers 10 do not hang out, that is, are not lengthened and therefore stretched in an undesirable manner.

The slides 57 consist of sheet metal strips or plastic strips which are provided with a profiling in the form of longitudinal grooves 58 which receive the slivers 10 and also guide them laterally. During the machine operation, the slides 57 may vibrate slightly because of machine vibrations which reduces the frictional effect on the slivers 10. A relatively slight pulling force will then be sufficient which is applied by the three-cylinder drafting units 3 in order to convey the slivers 10 on the slides 57 without drafting them. In the case of a machine stoppage, there are no machine vibrations so that then the frictional effect of the slides 57 with respect to the slivers 10 will be less pronounced.

As shown in FIG. 4, cleaning elements, such as stripping rollers 59, are assigned to the returning ends 55 of the conveyor belts 51 and strip the fiber residue, fiber fly, or the like off the conveyor belts 51.

Figure 5:
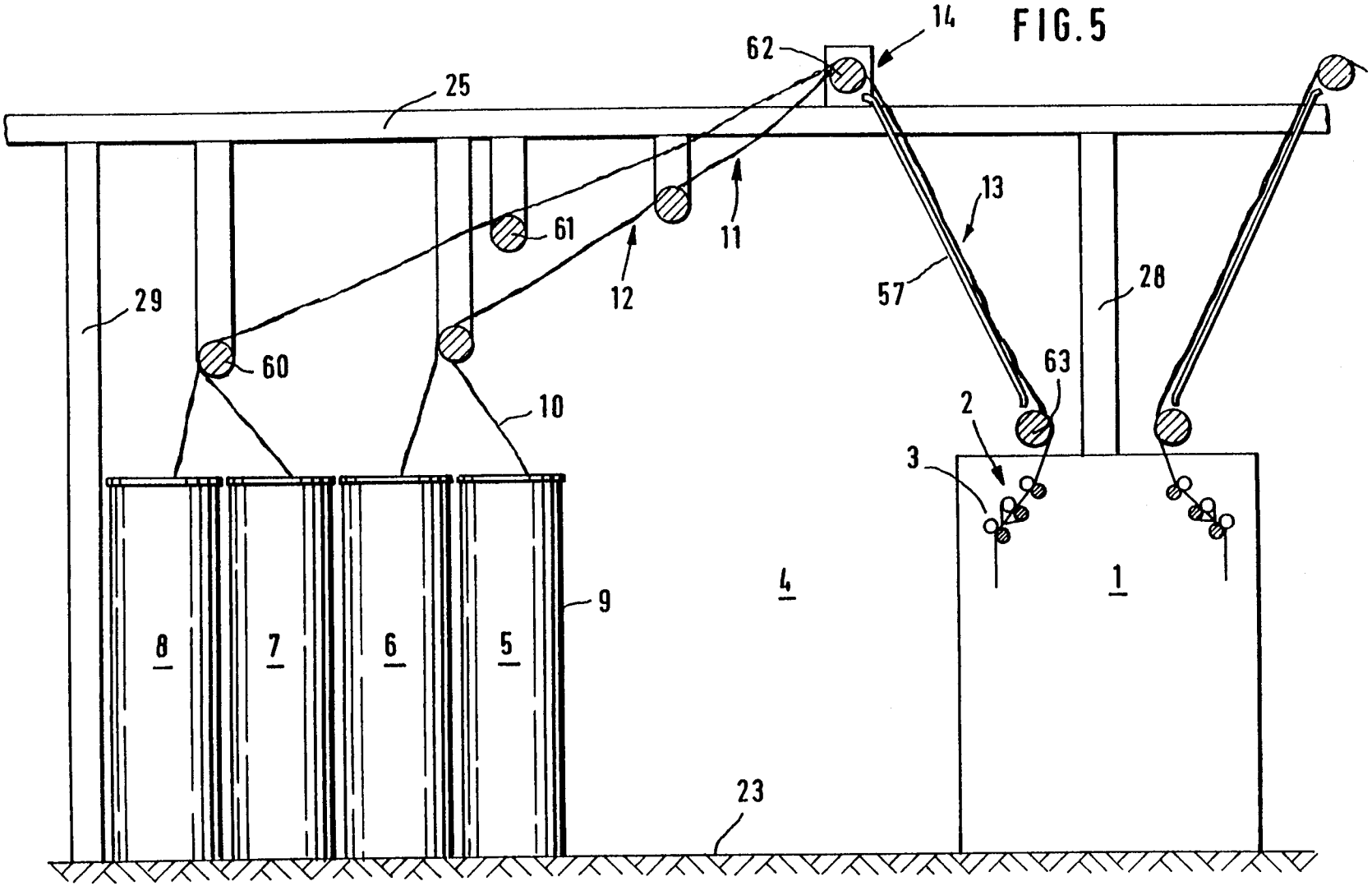
FIG. 5 is a partial view similar to FIG. 4** in which the first transport section is formed of guide rollers and the second transport section is formed of slides.

In the embodiment according to FIG. 5, the second transport sections 13 of the transport devices 11 are formed by slides 57 corresponding to the embodiment according to FIG. 4. These slides 57 are followed by a driven guide roller 63 which feeds the slivers 10 to the drafting units 3 of the spinning stations 2. This guide roller is constructed as a shaft which extends through in the longitudinal direction of the machine and is driven at the machine end.

The first transport section 12 of the transport devices of the embodiment according to FIG. 5 is formed by driven guide rollers 60, 61, 62 which are constructed as driven shafts extending through in the longitudinal direction of the machine. One of these guide rollers 60 respectively is situated in the area between two cans 9 of adjacent rows 5, 6; 7, 8 from which slivers 10 are withdrawn which are fed to two adjacent drafting units 3 which, in a manner not shown in detail, have joint load carriers and joint pressure roller twins as the pressure rollers. The deflecting roller 62 forms the deflecting guide 14 which is followed by the slides 57. The center rollers 61 are used for supporting the slivers 10 in order to prevent a hanging-out and thus lengthening of the slivers 10 during the transport. As a function of the slivers, naturally also more than one guide roller 61 can be arranged between the guide rollers 60 and 62.

It should be pointed out that all deflecting rollers or guide rollers may be provided with lateral borders, although this is not shown. These lateral borders are used for the lateral guiding of the slivers 10 and/or of the conveyor belts 15, 51.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A spinning machine having a machine frame, comprising:

a plurality of spinning stations arranged along at least one side of a spinning machine, each of said spinning stations having a front side facing an operating aisle for accommodating operating personnel access to the respective front sides of the spinning stations;

depositing sites for cans containing sliver to be spun in the respective spinning stations, said depositing sites being arranged adjacent the operating aisle at the side thereof opposite the front side of the spinning stations, sliver transport devices for supporting and transporting sliver upwardly from the cans and above and over the operating aisle in the manner of a roof to the spinning stations, and a frame attached to the machine frame of the spinning machine and on which the sliver transport devices are mounted, wherein the frame bridges in a manner of a roof the operating aisle and includes means for holding at least one auxiliary device.

2. A spinning machine according to claim 1, wherein the depositing sites of the cans are arranged on a platform in an elevated manner.

3. A spinning machine according to claim 2, wherein a plurality of said spinning stations are provided which have a common drive unit, said spinning stations being arranged adjacent one another in a row along at least one side of a spinning machine.

4. A spinning machine according to claim 1, wherein the transport speed of the slivers is approximately 1.5% lower than the feeding speed of the spinning stations.

5. A spinning machine according to claim 1, wherein transport devices for the cans are provided which extend in the longitudinal direction of the machine and form the depositing sites for the cans.

6. A spinning machine according to claim 5, wherein a plurality of said spinning stations are provided which have a common drive unit, said spinning stations being arranged adjacent one another in a row along at least one side of a spinning machine.

7. A spinning machine according to claim 1, wherein a plurality of said spinning stations are provided which have a common drive unit, said spinning stations being arranged adjacent one another in a row along at least one side of a spinning machine.

8. A spinning machine according to claim 1, wherein the sliver transport devices include a first transport section starting above the cans and a second section connected to the first transport section and leading to above the respective spinning station.

9. A spinning machine according to claim 8, wherein the transport sections are connected with one another by means of a deflecting guide which forms the highest point of the transport devices.

10. A spinning machine according to claim 9, wherein the transport devices comprise a continuous conveyor belt which forms the respective first transport section, and wherein the conveyor belt is followed downstream of the deflecting guide by a downwardly extending transport path which forms the second transport section.

11. A spinning machine according to claim 10, wherein the second transport section is formed by a slide which extends from the deflecting guide diagonally downward to the spinning station.

12. A spinning machine according to claim 11, wherein the slide is provided with profilings holding the slivers separate from one another.

13. A spinning machine according to claim 11, wherein a plurality of said spinning stations are provided which have a common drive unit, said spinning stations being arranged adjacent one another in a row along at least one side of a spinning machine.

14. A spinning machine according to claim 8, wherein the first transport section is aligned essentially horizontally, and the second transport section is aligned essentially vertically.

15. A spinning machine according to claim 8, wherein the first transport section extends diagonally upward to a deflecting guide, and wherein the second transport section extends diagonally downward from the deflecting guide, the deflecting guide being arranged above the operating aisle.

16. A spinning machine according to claim 8, wherein the depository sites for the cans include two adjacent rows of cans, and wherein the first transport section starts approximately in the center between the depositing sites of the two adjacent rows.

17. A spinning machine according to claim 8, wherein the transport devices comprise a continuous conveyor belt which travels along both transport sections.

18. A spinning machine according to claim 17, wherein returning sides of the conveyor belt are guided essentially in parallel to the sides conveying the slivers.

19. A spinning machine according to claim 17, wherein the conveyor belt is provided with covering.

20. A spinning machine according to claim 17, wherein the conveyor belt is designed for conveying at least two slivers and is assigned to at least two adjacent spinning stations.

21. A spinning machine according to claim 20, wherein depositing sites for cans are arranged in rows, wherein those depositing sites that are in rows that are disposed next to one another are assigned to one conveyor belt respectively.

22. A spinning machine according to claim 20, wherein the conveyor belt is provided with devices which keep the slivers separate from one another.

23. A spinning machine according to claim 17, wherein a plurality of said spinning stations are provided which have a common drive unit, said spinning stations being arranged adjacent one another in a row along at least one side of a spinning machine.

24. A spinning machine according to claim 8, wherein the first transport section is formed by preferably driven guide rollers, of which one driven guide roller respectively is arranged above the cans and one driven guide roller forms a deflecting guide.

25. A spinning machine according to claim 24, wherein a plurality of said spinning stations are provided which have a common drive unit, said spinning stations being arranged adjacent one another in a row along at least one side of a spinning machine.

26. A spinning machine having a machine frame, comprising:

a plurality of spinning stations arranged along at least one side of a spinning machine, each of said spinning stations having a front side facing an operating aisle for accommodating operating personnel access to the respective front sides of the spinning stations;

depositing sites for cans containing sliver to be spun in the respective spinning stations, said depositing sites being arranged adjacent the operating aisle at the side thereof opposite the front side of the spinning stations, and sliver transport devices for supporting and transporting sliver upwardly from the cans and above and over the operating aisle in the manner of a roof to the spinning stations, and a frame attached to the machine frame of the spinning machine and on which the sliver transport devices are mounted, wherein the frame bridges in a manner of a roof the operating aisle and includes rails for a travelling blower.

* * * * *